US008969695B1

(12) United States Patent
Fernandez

(10) Patent No.: US 8,969,695 B1
(45) Date of Patent: Mar. 3, 2015

(54) SYSTEM FOR CONTROLLING THE TENSION AND TRAVEL OF A SAXOPHONE PLAYER'S FINGERS

(76) Inventor: Carlos Fernandez, Boston, MA (US)

( * ) Notice: Subject to any disclaimer, the term of this patent is extended or adjusted under 35 U.S.C. 154(b) by 373 days.

(21) Appl. No.: 13/506,362

(22) Filed: Apr. 13, 2012

(51) Int. Cl.
*G10D 9/04* (2006.01)

(52) U.S. Cl.
USPC ..... 84/385 R

(58) Field of Classification Search
USPC ..... 84/385 R
See application file for complete search history.

(56) References Cited

U.S. PATENT DOCUMENTS 389,346 A * 9/1888 Utzinger ..... 248/443
853,074 A * 5/1907 Evans et al. ..... 84/387 R
2,556,535 A * 6/1951 Hansen ..... 84/382
2,918,838 A * 12/1959 Worrel ..... 84/465
4,285,263 A * 8/1981 Larsen ..... 84/382
4,909,123 A * 3/1990 Butenschon, III ..... 84/382
6,476,302 B1 * 11/2002 Liu ..... 84/385 R

* cited by examiner

*Primary Examiner* — Christopher Uhlir

(57) ABSTRACT

A saxophone having a body, a neck including a plurality of keys mounted thereon, each of said keys including an actuating surface and a bell including a valve protector, the improvement comprising a system for controlling the tension and travel of a saxophone player's fingers of both hands with a right hand device and a left hand device. The right hand device has an anchorage assembly mounted to the valve protector and a travel stopper elongated portion integrally extending from the anchorage assembly and kept at a substantially parallel and spaced apart relationship with respect to an actuating surface's plurality of keys thereby limiting the extension movement of a user's fingers as he or she actuates the keys. The left hand device includes an elongate stopper member with anchorage assemblies at its ends. The left hand device is rotatably mounted to facilitate its storage in storage cases.

5 Claims, 9 Drawing Sheets

SYSTEM FOR CONTROLLING THE TENSION AND TRAVEL OF A SAXOPHONE PLAYER'S FINGERS

This is a divisional application of application Ser. No. 12/781,23 filed on May 17, 2010 now U.S. Pat. No. 8,168, 872.

BACKGROUND OF THE INVENTION

1. Field of the Invention

The present invention relates to a device for controlling the tension and travel of a saxophone player's fingers.

2. Other Related Applications

The present application is based on the provisional U.S. patent application No. 61/216,153, filed on May 15, 2009, which is hereby incorporated by reference.

3. Description of the Related Art

Many musical instruments require the use of keys that are actuated by a user's fingers. Not infrequently playing these instruments requires the flexing and extending of fingers in a manner that can derive trauma, including tendonitis. This is particularly true with saxophones where a user's fingers have to selectively apply forces of a predetermined magnitude to actuate the keys. In doing this, a user's extension of his or her fingers (typically the index, middle, and ring fingers) travel (lifting) beyond the plane of the surface of the actuating keys. Extending a finger a beyond a certain distance is not necessary to actuate the keys and in fact results in wasted travel time, fatigue, and, more importantly, trauma.

Nonetheless, this excessive travel of the fingers is recurrent with novices and some experienced saxophone players, like the applicant herein, wherein the excessive travel of the fingers is unconscious and habit forming. The present invention resolves this problem by limiting the travel of the player's fingers to a distance corresponding with proper technique.

SUMMARY OF THE INVENTION

It is one of the objects of the present invention to provide a device that will permit a user to limit the unnecessary travel (extension) of his or her fingers.

It is another object of the present invention to provide such a device for a saxophone of the Boehm type that limits the travel of a user's fingers of both hands.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
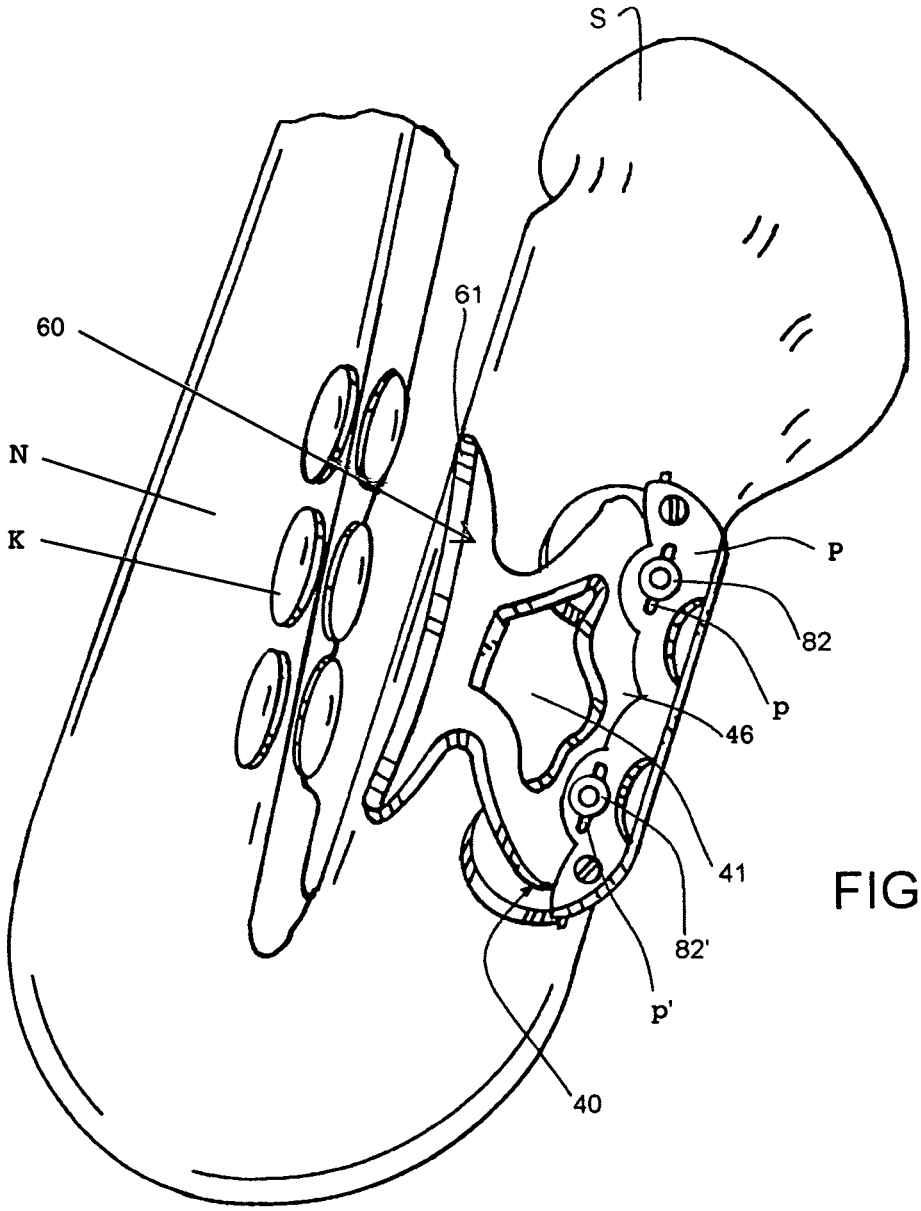
FIG. 1 represents an isometric view of a saxophone incorporating one of the embodiments of the device claimed herein.

Referring now to the drawings, where the present invention for the right hand fingers is generally referred to a system for controlling the tension and travel of a user's fingers of both hands. Device 10 is used for the right hand of a user and device 100 is used for his or her left hand. Device 10 basically includes a finger travel stopper elongated member 60 with a dividing longitudinal bend defining an anchorage assembly 40 and a fastening assembly 80 for removably mounting assembly 40 to a valve protector P in a saxophone S. The valve protector P is found in most saxophones and protects the valves from being accidentally damaged. Valve protectors P are rigidally mounted to the body of saxophone S and provide the necessary structure to mount anchorage assembly 40 thereon.

As seen in FIG. 1, finger travel stopper member 60 is made out of a rigid material, preferably transparent, to minimize any detracting effect to the aesthetics of the instrument. Finger stopper elongate member 60 is positioned at a substantially parallel and spaced apart relationship with respect to the actuating surfaces of keys K on saxophone S. Finger travel stopper member 60 includes an irregular curvature or slope 61 which functions to limit the different extension movements of a user's fingers. Users have fingers with different dimensions. Curvature or slope 61 is adapted to a user's finger dimensions.

Anchorage assembly 40 includes anchorage frame 46, which is secured to a valve protector P in saxophone S, as seen in FIG. 1. Anchorage frame 46 is preferably mounted under (fastened) to valve protector P with screws 82; 82' which are inserted through valve protector slots P; P' and also through through-bores 81; 81' respectively. Anchorage assembly 40 includes cutouts 42; 42', which are adjacent to distal ends 45'; 45' of anchorage frame 46. Cutouts 42; 42' have a cooperative shape to further engage anchorage frame 46 to valve protector P. Anchorage assembly 40 includes aperture 41 to minimize the possibility of obstructing structural elements of saxophone S.

Figure 2:
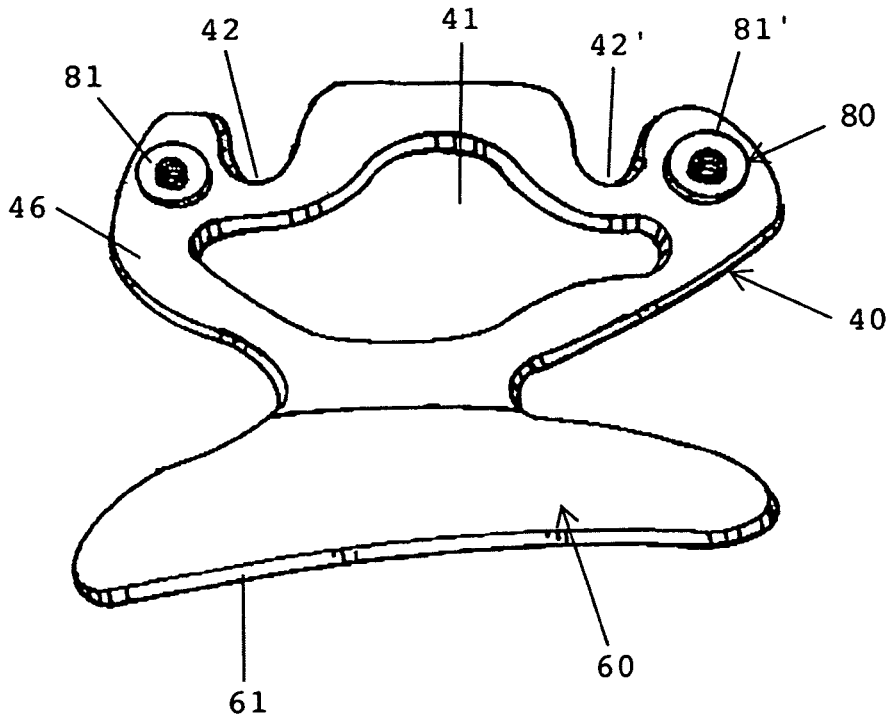
FIG. 2 shows a top view of the device.
Figure 3:
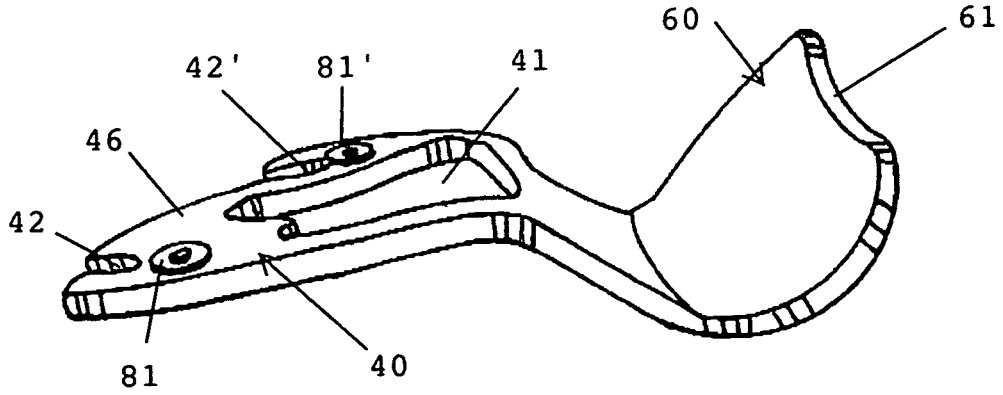
FIG. 3 illustrates a side view of the device.
Figure 4:
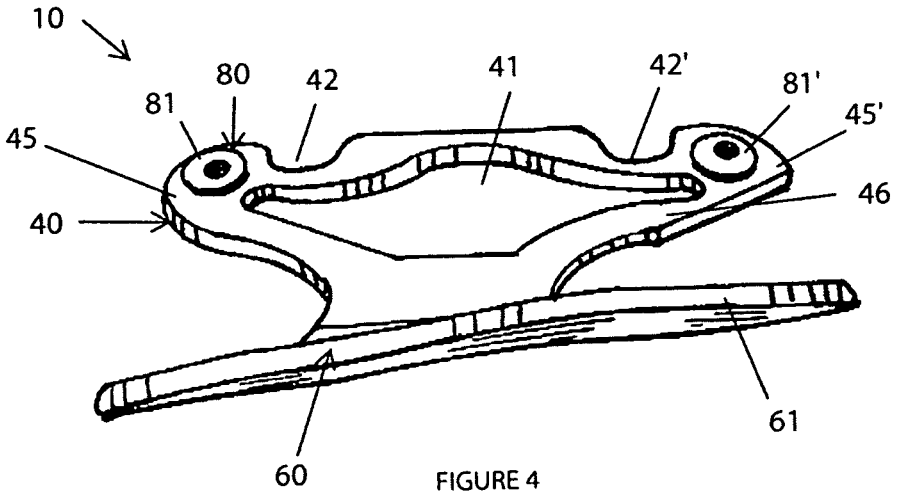
FIG. 4 shows a front view of the device showing the curvature of elongated member 60, which allows for different travel distances needed by 168
Figure 5:
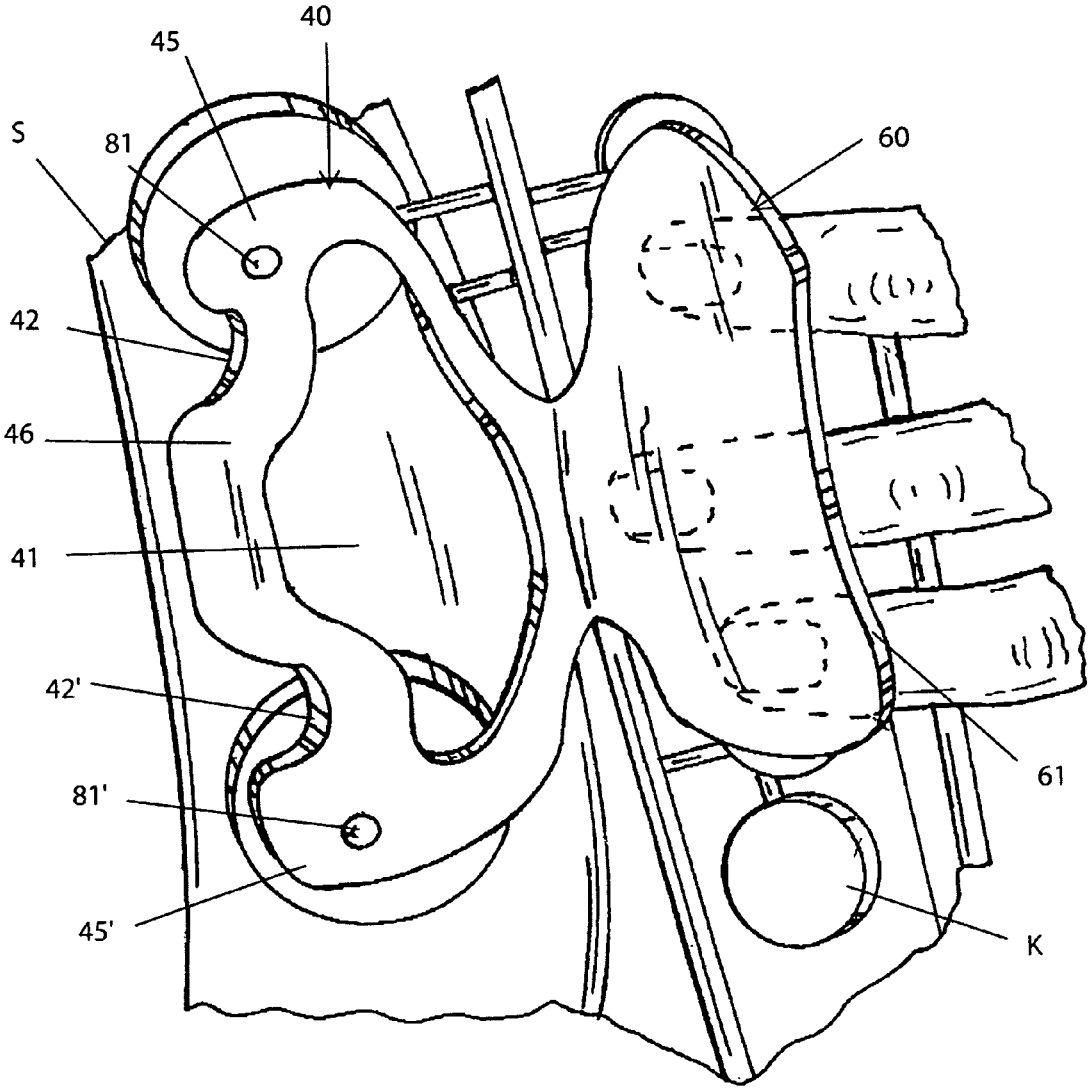
FIG. 5 is a representation of a top view of device 10 mounted to saxophone S with a user's fingers partially represented in broken lines.

As seen in FIG. 2, fastening assembly 80 is located on the distal ends of anchorage assembly 40. Fastening assembly 80 includes through bores 81; 81' which allow screws 82; 82' to secure the present invention 10 to valve protector P.

Device 100 for the left hand of a user is shown in FIGS. 6 through 10 and it can be seen to include travel stopper elongate member 160 and anchorage assemblies 140; 140'. Anchorage assembly 140 includes integrally extending plate 162.

Figure 6:
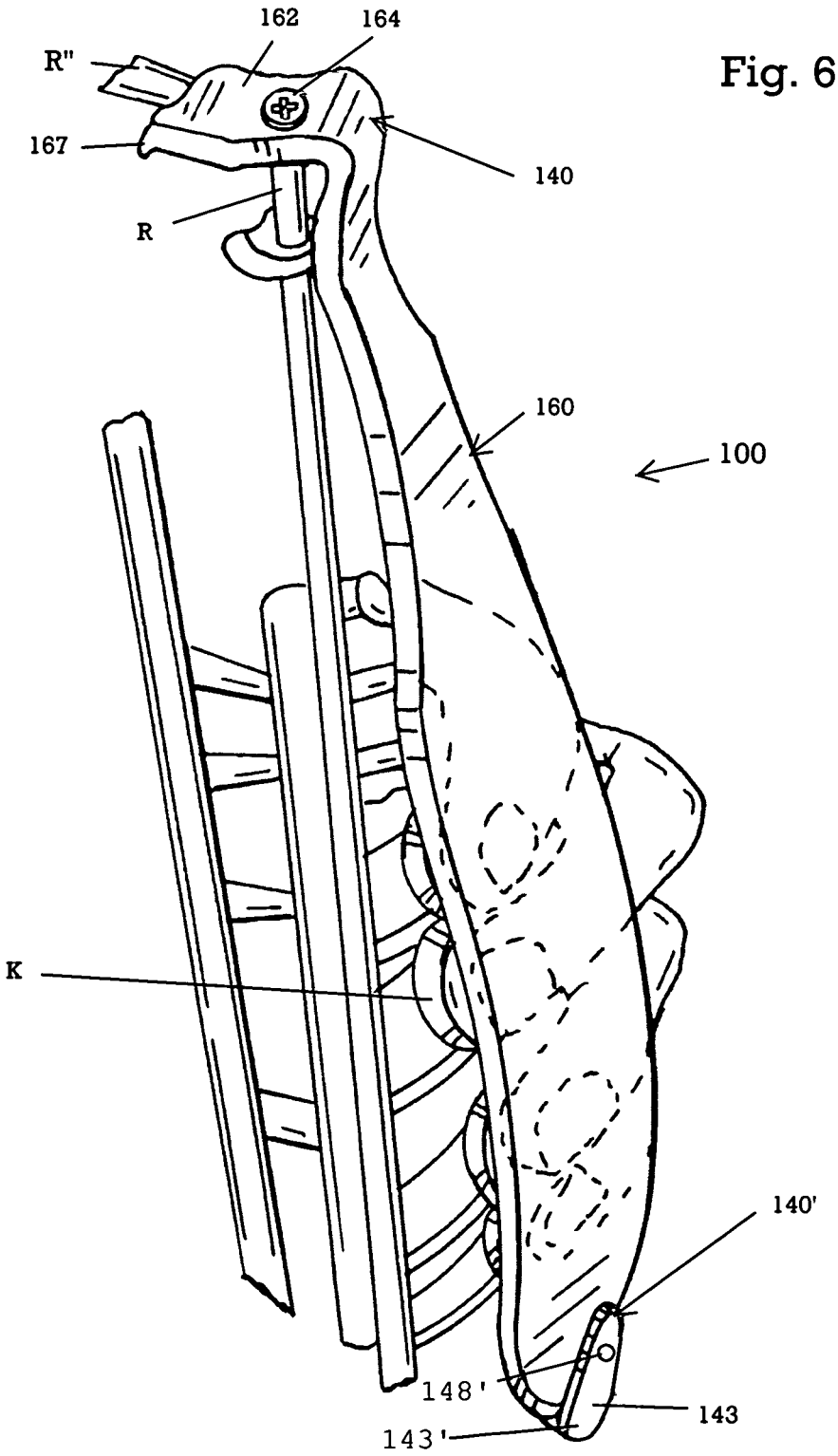
FIG. 6 shows an isometric side view of device 100 for left handed users mounted to saxophone S wherein the travel distance of a user's left hand fingers are limited by elongated stopper member 160.
Figure 7:
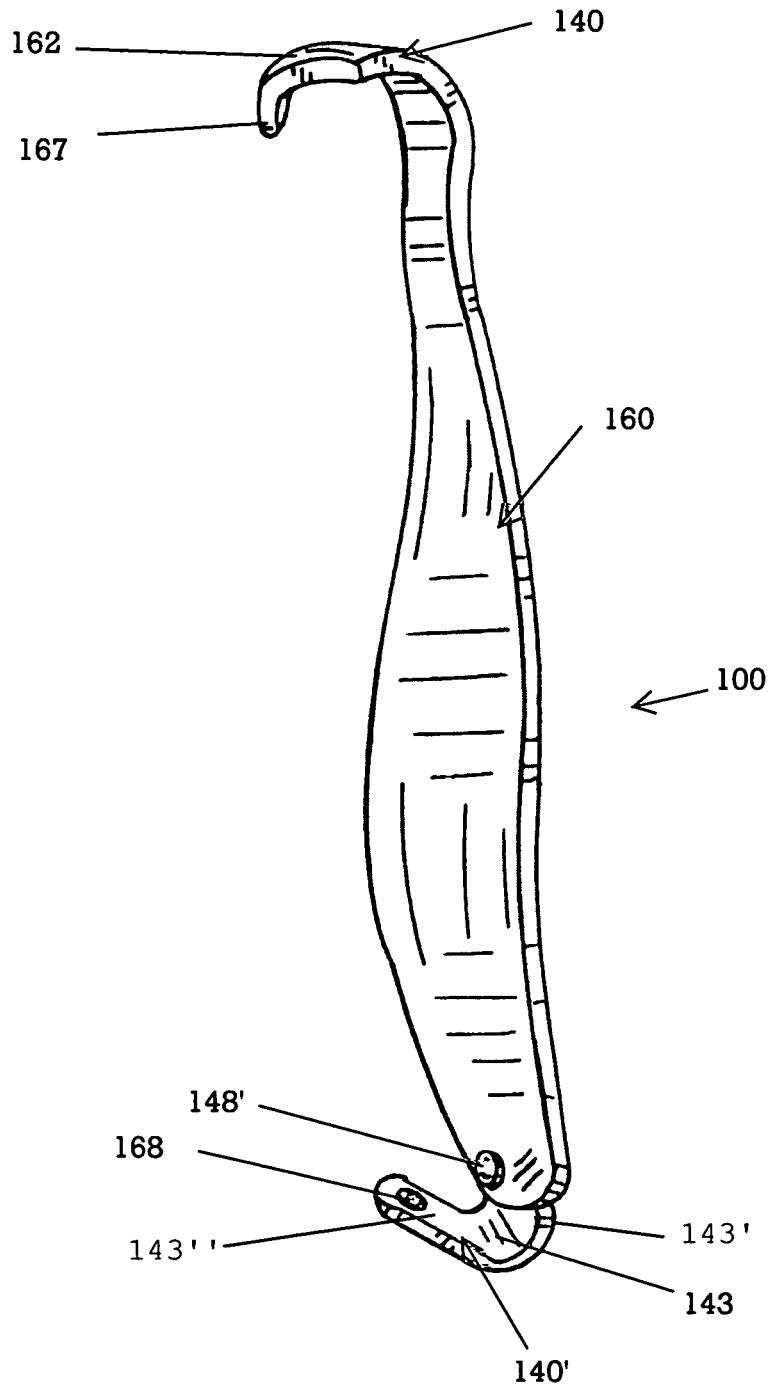
FIG. 7 illustrates an isometric side view for device 100.
Figure 8:
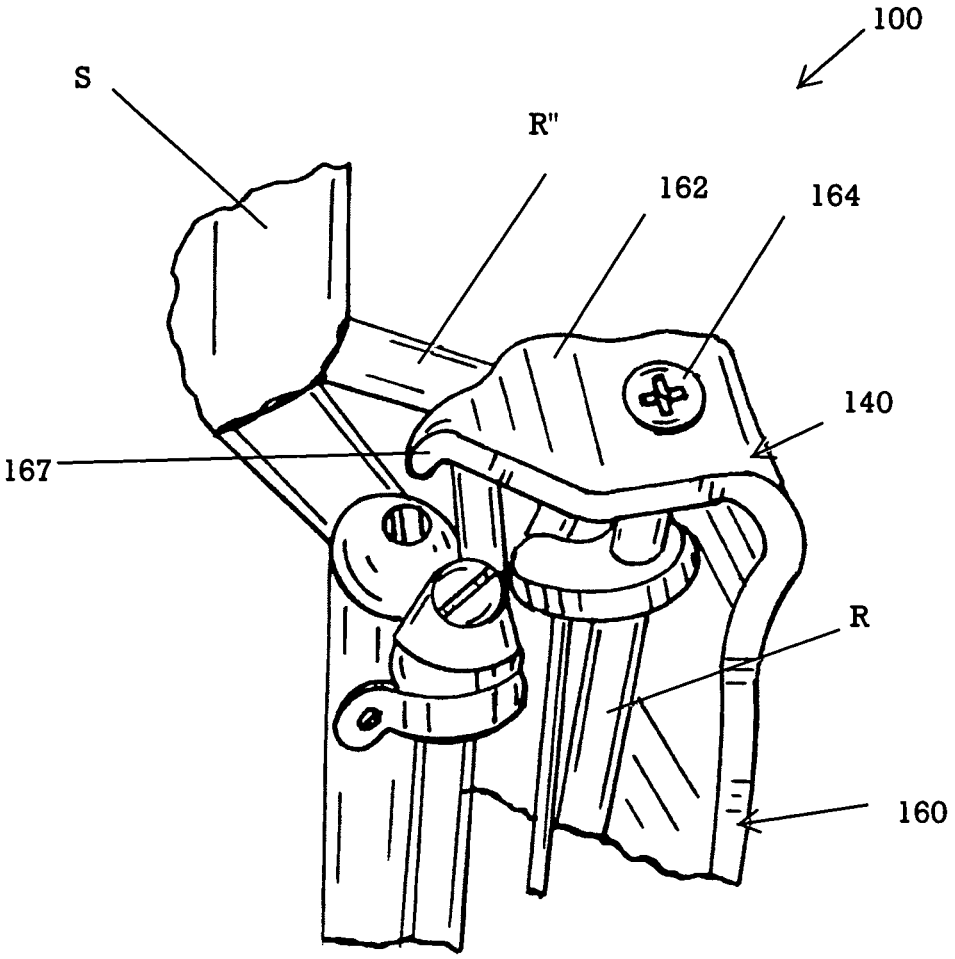
FIG. 8 represents an enlarged detail upper portion of device 100 shown in the previous figure, showing end tip 167 and coacting with rod member R".
Figure 9:
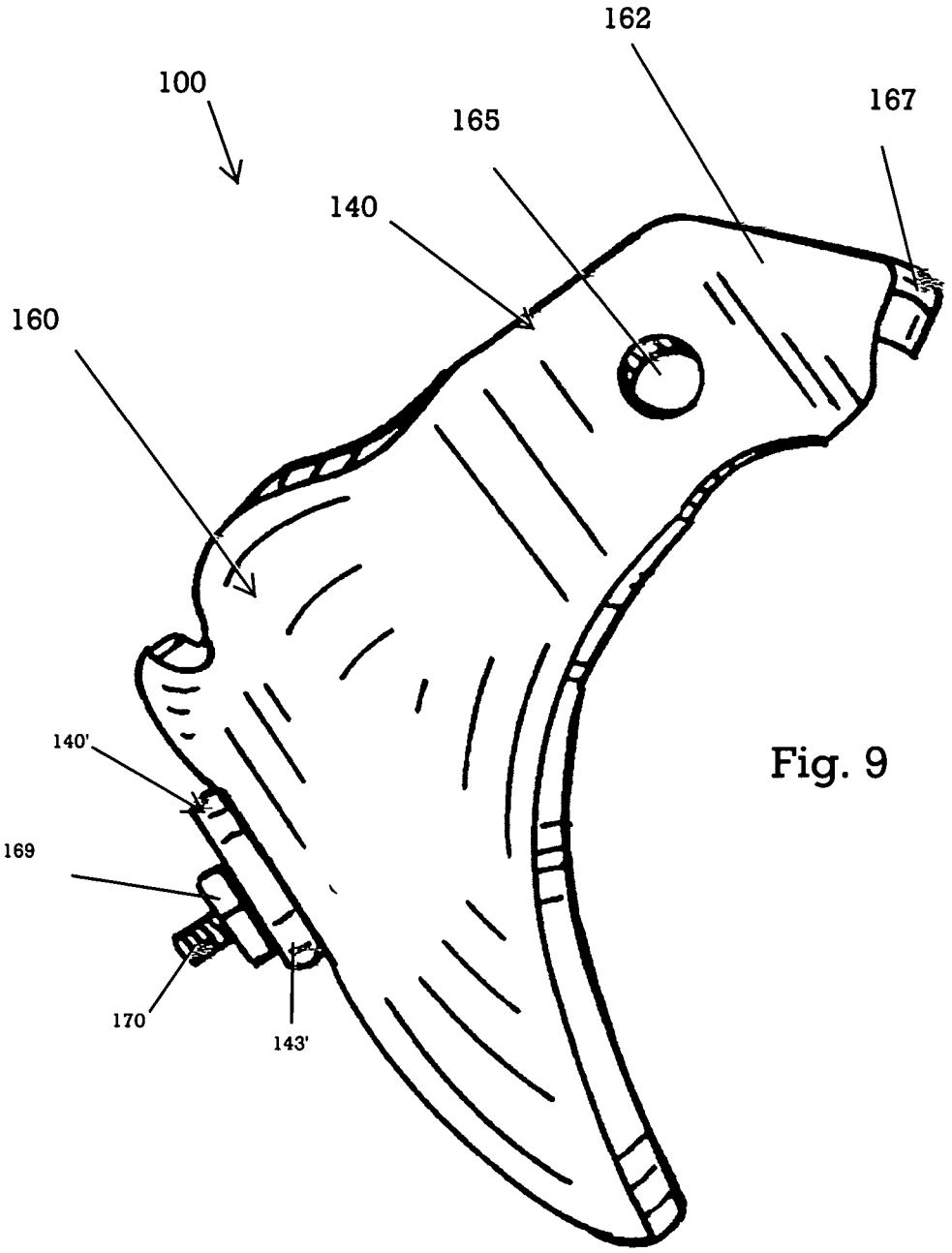
FIG. 9 shows a top view of device 100 shown in the previous figure in which through hole 165 can be seen.

Plate 162 is mounted to rod R that extends substantially longitudinally and adjacent to the keys K, which is characteristic of the Boehm system in saxophone S as seen in FIG. 6. Screw 164 passes through through hole 165. Rod R pertains to the G note. Screw 164 is tightened with sufficient strength to rod R to prevent a rotational movement of device 100 unless a force of a predetermined magnitude is applied. Support extension R" of rod R is at a substantially perpendicular disposition and is anchored to the body of saxophone S.

Plate 162 includes tip 167 that limits the rotation upon contact with rod R". As the user exerts a rotational force on elongate stopper member 160, the rotation continues until stopped by tip 167 coming in contact with rod R". When the user wants to pack his or her saxophone without removing device 100, the latter is simply rotated. Device 100 is rotated enough to fit most carrying cases.

Figure 10:
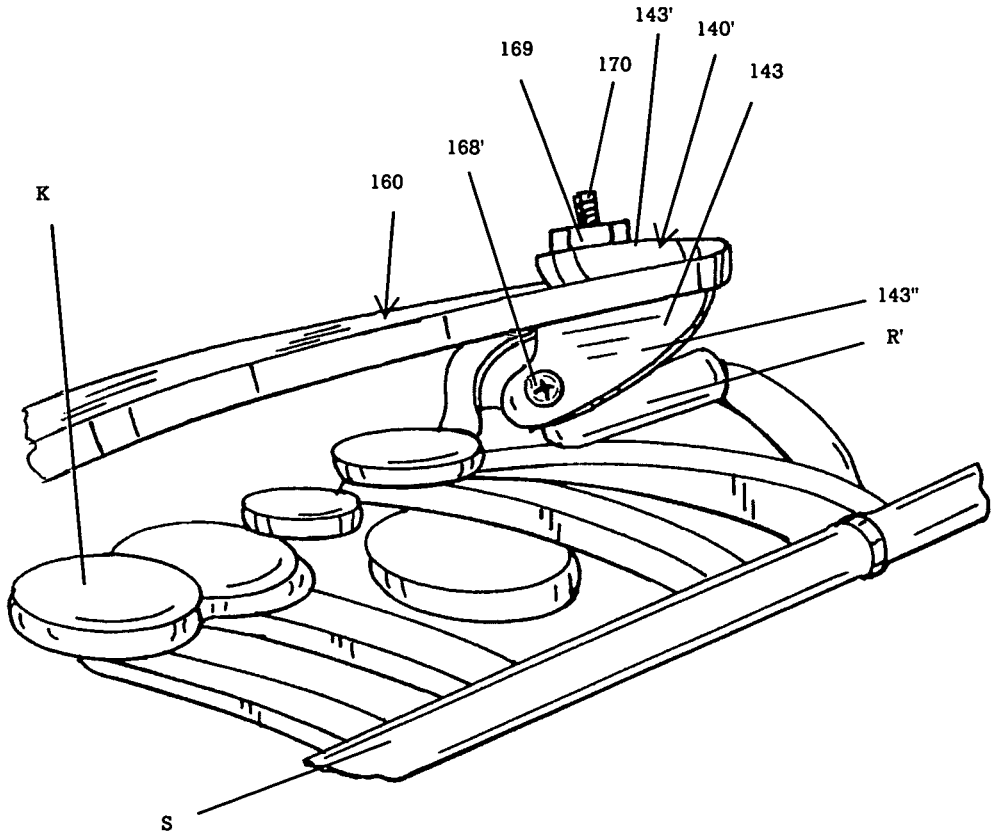
FIG. 10 represents an isometric side view for device 100 for the left hand of a user mounted to saxophone S further showing bottom end 163.

As shown in FIG. 10, bottom angular plate 143 of device 100 is rotatably mounted to stopper elongate member 160 with a fastening member, such as nut 169 and bolt 170. Bolt 170 passes through through holes 148 and 148'. Bottom angular plate 143 is rotatably mounted to the end of stopper elongate member 160 to provide some adjustment flexibility in the installation of device 100. The characteristic rods and other components of saxophone S require some adjustments in the mounting of device 100. Rod R' corresponds to the low natural B key.

What is claimed is:

1. In a saxophone having a Boehm system body, a neck including a plurality of keys mounted thereon, each of said keys including an actuating surface, and said saxophone further including a bell with a valve protector, a first rod associated with the G note including a first extension mounted to said body, a second rod associated with the low natural B key and second extension connected to said body, the improvement comprising a device having a travel stopper elongated member having first and second ends, first and second anchorage assemblies, said first anchorage assembly integrally and substantially perpendicularly extending from said first end and rotatably mounted to said first rod and said second anchorage assembly being rotatably mounted to said second end and also rotatably mounted to said second rod so that said travel stopper elongated member is kept at a substantially parallel and spaced apart relationship with respect to said actuating surfaces of said plurality of keys thereby limiting extension movement of a user's left hand fingers as he or she actuates said keys.

2. The improvement set forth in claim 1 wherein said first anchorage assembly includes a plate that is rotatably mounted to said first rod, said plate having one through hole and one fastening member to pass therethrough and removably engage said first rod.

3. The improvement set forth in claim 2 wherein said plate includes a tip to limit rotation of said plate when in contact with said first extension upon a user exerting a rotational force on said elongate travel stopper member to overcome an engagement of said first and second anchorage assemblies.

4. The improvement set forth in claim 1 wherein said second anchorage assembly includes an angular plate that is rotatably mounted to said second rod and one through hole and one fastening member to pass therethrough and removably engage said second rod.

5. The improvement set forth in claim 1 wherein said device is made out of transparent rigid material.

* * * * *